US012194588B2

(12) United States Patent
Kennedy et al.

(10) Patent No.: US 12,194,588 B2
(45) Date of Patent: Jan. 14, 2025

(54) SYSTEM AND METHOD FOR AUTOMATED SHARPENING OR RESHARPENING OF CUTTING TOOLS

(71) Applicant: Dexter-Russell, Inc., Southbridge, MA (US)

(72) Inventors: Thomas J. Kennedy, West Brookfield, MA (US); David F. Bentley, Warwick, RI (US); Chinmay Harmalkar, Ashland, MA (US); Tyler Kelly, Cumberland, RI (US)

(73) Assignee: Dexter-Russell, Inc., Southbridge, MA (US)

( * ) Notice: Subject to any disclaimer, the term of this patent is extended or adjusted under 35 U.S.C. 154(b) by 742 days.

(21) Appl. No.: 17/400,952

(22) Filed: Aug. 12, 2021

(65) Prior Publication Data

US 2023/0049183 A1 Feb. 16, 2023

(51) Int. Cl.
*B24B 3/36* (2006.01)
*B24B 51/00* (2006.01)

(52) U.S. Cl.
CPC ..... *B24B 3/36* (2013.01); *B24B 51/00* (2013.01)

(58) Field of Classification Search
CPC .... B24B 3/52; B24B 3/54; B24B 3/36; B24D 19/002; B24D 15/063; B24D 15/065; B24D 15/08; B24D 15/085; B25J 9/1697; B25J 11/0065
See application file for complete search history.

(56) References Cited

U.S. PATENT DOCUMENTS

| | | | | |
|---|---|---|---|---|
| 6,015,174 | A * | 1/2000 | Raes | B25J 15/0253 294/185 |
| 6,663,465 | B2 | 12/2003 | Gross | |
| 8,758,084 | B2 | 6/2014 | Knecht et al. | |
| 9,902,039 | B2 | 2/2018 | Vogel et al. | |
| 10,569,377 | B2 | 2/2020 | Robinson et al. | |
| 10,661,406 | B2 | 5/2020 | Graves et al. | |
| 2011/0281503 | A1* | 11/2011 | Knecht | B24B 49/02 451/5 |
| 2012/0156964 | A1* | 6/2012 | Anderson | B24B 3/54 451/259 |
| 2018/0236623 | A1* | 8/2018 | Robinson | B24B 53/003 |
| 2019/0126423 | A1* | 5/2019 | Lyons | B24B 3/54 |
| 2019/0210177 | A1* | 7/2019 | Graves | B24B 55/02 |
| 2019/0366499 | A1* | 12/2019 | Rosenblatt | B24B 3/54 |
| 2020/0246933 | A1* | 8/2020 | Fowler | B24B 49/12 |
| 2020/0254617 | A1 | 8/2020 | Aldridge et al. | |

FOREIGN PATENT DOCUMENTS

| | | | | |
|---|---|---|---|---|
| IT | M020100312 | A1 | 5/2012 | |
| WO | WO-2016183663 | A1 * | 11/2016 | A63C 3/10 |

* cited by examiner

*Primary Examiner* — Joel D Crandall
(74) *Attorney, Agent, or Firm* — Bulkley, Richardson and Gelinas, LLP; Mary R. Bonzagni, Esq.

(57) ABSTRACT

A robotic sharpening system and method for rapidly and accurately sharpening or resharpening cutting tools is provided. The inventive system employs a robotic arm that grasps each cutting tool by its cutting blade instead of by its handle, thereby reducing flex during the sharpening process. This results in a more accurate and consistent sharpening by consistently providing an even bevel at the knife edge regardless of minor imperfections (i.e., a bend or warp) in the blade surface. In addition, it renders the system uninfluenced by the size or shape of the handle of the cutting tool.

35 Claims, 10 Drawing Sheets

SYSTEM AND METHOD FOR AUTOMATED SHARPENING OR RESHARPENING OF CUTTING TOOLS

TECHNICAL FIELD

The present invention relates generally to a robotic sharpening system and method, and more particularly to a robotic sharpening system and method for rapidly and accurately sharpening cutting tools, where a robotic arm grasps each cutting tool by its blade, thereby reducing flex during the sharpening process and rendering the system uninfluenced by the size or shape of the handle of the cutting tool.

BACKGROUND OF THE INVENTION

A cutting tool such as a knife is only as good as the sharpness and integrity of its cutting edge. In the meat and poultry processing industries, where a myriad of knives are used daily, this is particularly true. The use of sharp knives serves to improve accuracy and performance and thus bolster production by increasing yield and production and by lowering costs. Sharp knives also safeguard employees' health by decreasing strain and fatigue, thus helping prevent musculoskeletal injuries by reducing grip force and cutting time.

There have been previous attempts to robotize the process of sharpening cutting tools. Several of these prior art processes, all of which manipulate the cutting tools by their handles, are discussed below.

U.S. Pat. No. 10,569,377 to Robinson et al. (Omnisharp) relates to a robotic sharpening system. The system sharpens cutting tools by manipulating the tool, measuring the three-dimensional profile of the tool, and then grinding the tool. As shown in FIG. 2, a robot gripper head holds the knife handle such that both cutting edges are exposed for profiling and grinding.

U.S. Pat. No. 9,902,039 to Vogel et al. (Wolff) relates to systems and methods for conditioning blades. The disclosed system may include a gripper assembly that grips a cutting device and moves the cutting device within the system. The gripper assembly grips the handle of the cutting device, which is said to advantageously leave the blade exposed for conditioning. Conditioning may include grinding, buffing and/or polishing.

U.S. Pat. No. 8,758,084 to Knecht et al. (Knecht) relates to an apparatus for grinding hand knives. The grinding operation is preferably carried out in such a way that a hand knife can be seized at the handle by the gripper. This reportedly obviates a need to change the grip prior to initiating the grinding operation, as would be the case if the knife were seized in the blade region by the gripper.

U.S. Pat. No. 6,663,465 to Gross (Heinz Berger, Kuller) relates to a grinding machine and method of sharpening blades. The grinding machine uses a robot 3 which has a gripper head 8 with a holding device 9, which is fixed to a manipulator 5 of the robot 3. As shown in FIGS. 2 and 4, the holding device 9 grips a handle of blade 4.

Other disadvantages of grasping a cutting tool by the blade instead of by the handle, apart from potentially interfering with sharpening operations, include the inability of gripper fingers to grip the blade over time due to reductions in the blade width and length from recurrent sharpening operations, obscuration by the gripper fingers of Quick Response (QR) codes etched on knife edges, and reduction of gripping effectiveness resulting from the presence of substances such as oil and grease on blade surfaces.

It has been discovered by way of the present invention that manipulating the cutting tool by its blade instead of by its handle will reduce flex during the sharpening process resulting in a more rapid, accurate and consistent sharpening by consistently providing an even bevel at the knife edge of constant angle regardless of minor imperfections (i.e., a bend or warp) in the blade surface. In addition, it renders the system uninfluenced by the size or shape of the handle of the cutting tool.

SUMMARY OF THE INVENTION

The present invention therefore provides a system and method for automated sharpening or resharpening of cutting tools.

The inventive system comprises:

(a) one or more magazines for holding a plurality of cutting tools, wherein each cutting tool is made up of a handle and a blade, the blade having two lateral edges, an outer edge or spine and an inner edge for cutting ("the cutting edge");

(b) a vision station operable to produce a three-dimensional image of the blade of each cutting tool;

(c) one or more processing stations selected from the group including a grinding station and a polishing station;

(d) a robotic arm with a gripper, which is configured to locate and grip the blade of a cutting tool at a distance away from the cutting edge of the blade, to remove the cutting tool from its location in the one or more magazines and then to convey the cutting tool to the vision station, to the one or more processing stations and then back to the same location in the one or more magazines, and then to repeat the above sequence until all of the cutting tools in the one or more magazines are sharpened or resharpened; and (e) a control subsystem for controlling all operations of the system including the robotic arm.

In an exemplary embodiment, the system comprises one or more rotary magazines, which hang a plurality of cutting tools in a vertical fashion or orientation. Rotary magazines eliminate the need for specially designed, item specific racks or bins. In a preferred embodiment, two rotary magazines are used, which allow for an operator to safely load/unload one magazine while the robotic arm is sharpening from the other magazine.

In another exemplary embodiment, the vision station comprises one or more three-dimensional (3D) profilometers. In a preferred embodiment, the vision station also comprises a QR code scanning device.

In yet another exemplary embodiment, the one or more processing stations process each side of the entire cutting edge of each cutting tool in succession.

In a further exemplary embodiment, the robotic arm with a gripper is configured to grip the blade of each cutting tool at a distance of at least about 4.5 millimeters (mm) away from the cutting edge of the blade.

In yet a further exemplary embodiment, the gripper of the robotic arm has two oppositely disposed gripper fingers, wherein two gripper inserts are each mounted on one oppositely disposed gripper finger. In one such exemplary embodiment, the gripper inserts are coated with a material to increase friction to resist axial or rotational movement while the cutting tool is gripped by the gripper of the robotic arm.

The present invention further provides an automated method for sharpening or resharpening cutting tools using the system described above, which comprises arranging for the robotic arm to:

(a) locate a cutting tool positioned in the one or more magazines;
(b) grip the blade of the cutting tool at a distance away from the cutting edge of the blade;
(c) remove the cutting tool from its location in the one or more magazines;
(d) convey the cutting tool to the vision station where both sides of the blade are scanned to produce a three-dimensional image of the blade;
(e) convey the cutting tool to the one or more processing stations to sharpen or resharpen each side of the blade;
(f) convey the sharpened or resharpened cutting tool to the same location in the one or more magazines; and
(g) repeat steps (a) to (f) until all the cutting tools in the one or more magazines have been sharpened or resharpened.

In an exemplary embodiment, step (a) further comprises arranging for the robotic arm to locate a cutting tool positioned in one or more rotary magazines, which hang a plurality of cutting tools in a vertical fashion or orientation. In one such exemplary embodiment, the inventive system has two rotary magazines, and the automated method further includes the step of alerting the user when the cutting tools in one magazine have been processed and allowing the user to unload the sharpened or resharpened cutting tools and load the magazine with cutting tools in need of sharpening or resharpening.

In another exemplary embodiment, step (b) further comprises arranging for the robotic arm to grip the blade of the cutting tool at a distance of at least about 4.5 mm away from the cutting edge of the blade.

In yet another exemplary embodiment, step (e) further comprises arranging for the robotic arm to convey the cutting tool to the one or more processing stations to separately sharpen or resharpen each side of the blade of the cutting tool in succession.

Other features and advantages of the invention will be apparent to one of ordinary skill from the following detailed description. Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BRIEF DESCRIPTION OF THE DRAWINGS

The present disclosure may be better understood with reference to the following drawings. Matching reference numerals designate corresponding parts throughout the drawings, and components in the drawings are not necessarily to scale, emphasis instead being placed upon clearly illustrating the principles of the present disclosure. While exemplary embodiments are disclosed in connection with the drawings, there is no intent to limit the present disclosure to the embodiment or embodiments disclosed herein. On the contrary, the intent is to cover all alternatives, modifications, and equivalents.

Features of the disclosed invention are illustrated by reference to the accompanying drawings in which:

FIG. 2B is a perspective view of the end of arm gripper of the robotic arm providing the cutting tool for scanning one side of the blade at a vision station, in accordance with one exemplary embodiment of the present invention, while

FIG. 3A is a perspective view of the end of arm gripper of the robotic arm providing the cutting tool for grinding one side of the blade at the grinding station, in accordance with one exemplary embodiment of the present invention, while

FIG. 4A is a perspective view of the end of arm gripper of the robotic arm providing the cutting tool for polishing one side of the blade at the polishing station, in accordance with one exemplary embodiment of the present invention, while

FIG. 5A is a perspective view of the end of arm gripper of the robotic arm, which has two gripper inserts, each mounted on one oppositely disposed gripper finger, in accordance with one exemplary embodiment of the present invention, the gripper inserts holding one side of a blade against a grinding wheel, while

DETAILED DESCRIPTION OF THE INVENTION

Figure 1:
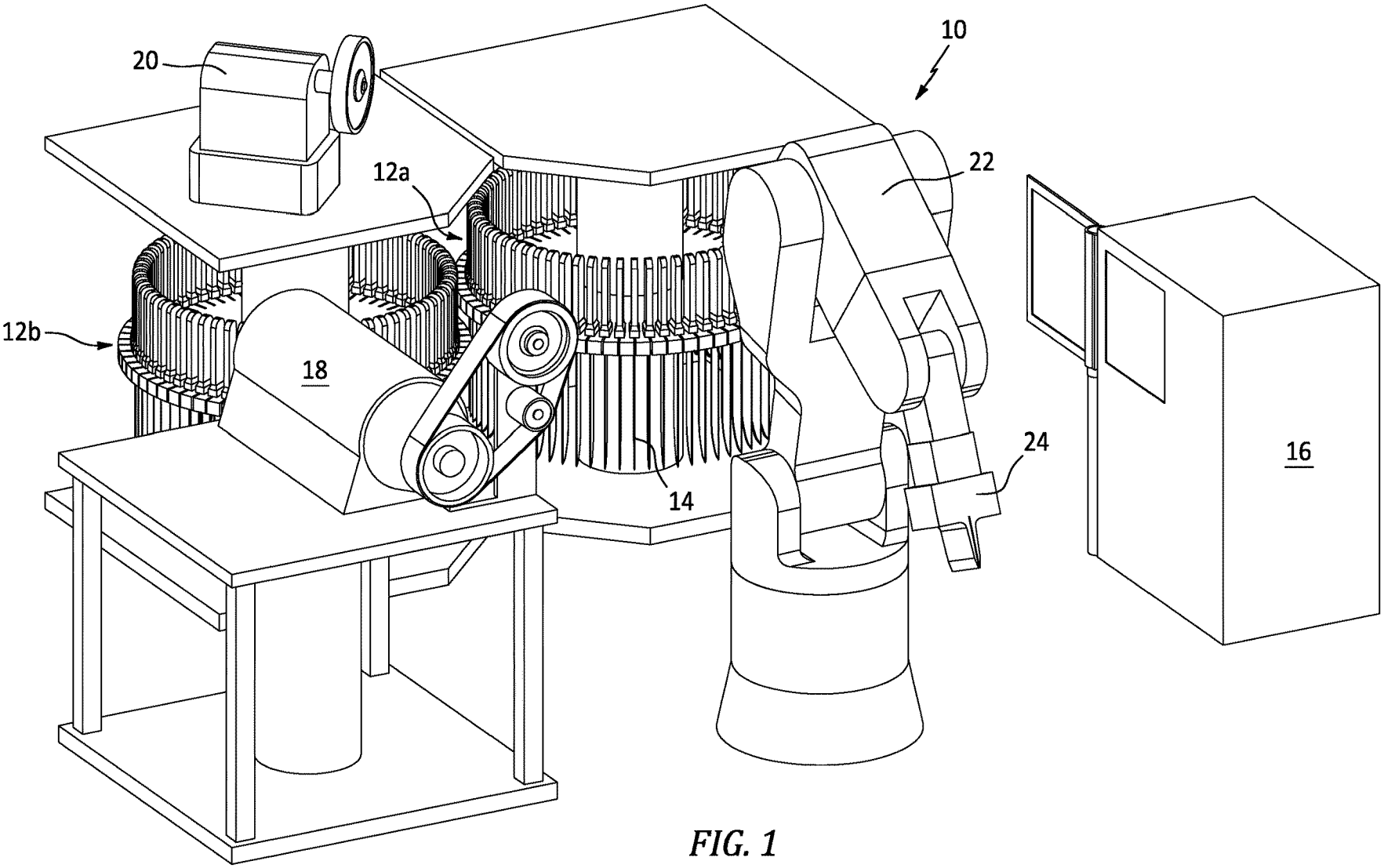
FIG. 1 is a perspective view of the system for automated sharpening or resharpening of cutting tools, in accordance with one exemplary embodiment of the present invention.

Cutting tools sharpened by way of the inventive system have blades with edge profiles which approximate the original edge profile of the blades, regardless of whether the blade has a minor bend or warp. Plus, the inventive system serves to remove minor defects or flaws such as nicks or scratches from the cutting edge of the blade.

The overall cycle time of the invention system (i.e., the time for one cutting tool to travel through the system and be returned to its original position in the magazine) ranges from about 15 to about 120 seconds, preferably, from about 15 to about 45 seconds.

Reference will now be made in detail to the description of embodiments as illustrated in the drawings. While several embodiments are described in connection with these drawings, there is no intent to limit the invention to the embodiment or embodiments disclosed herein. On the contrary, the intent is to cover all alternatives, modifications, and equivalents.

Figure 2A:
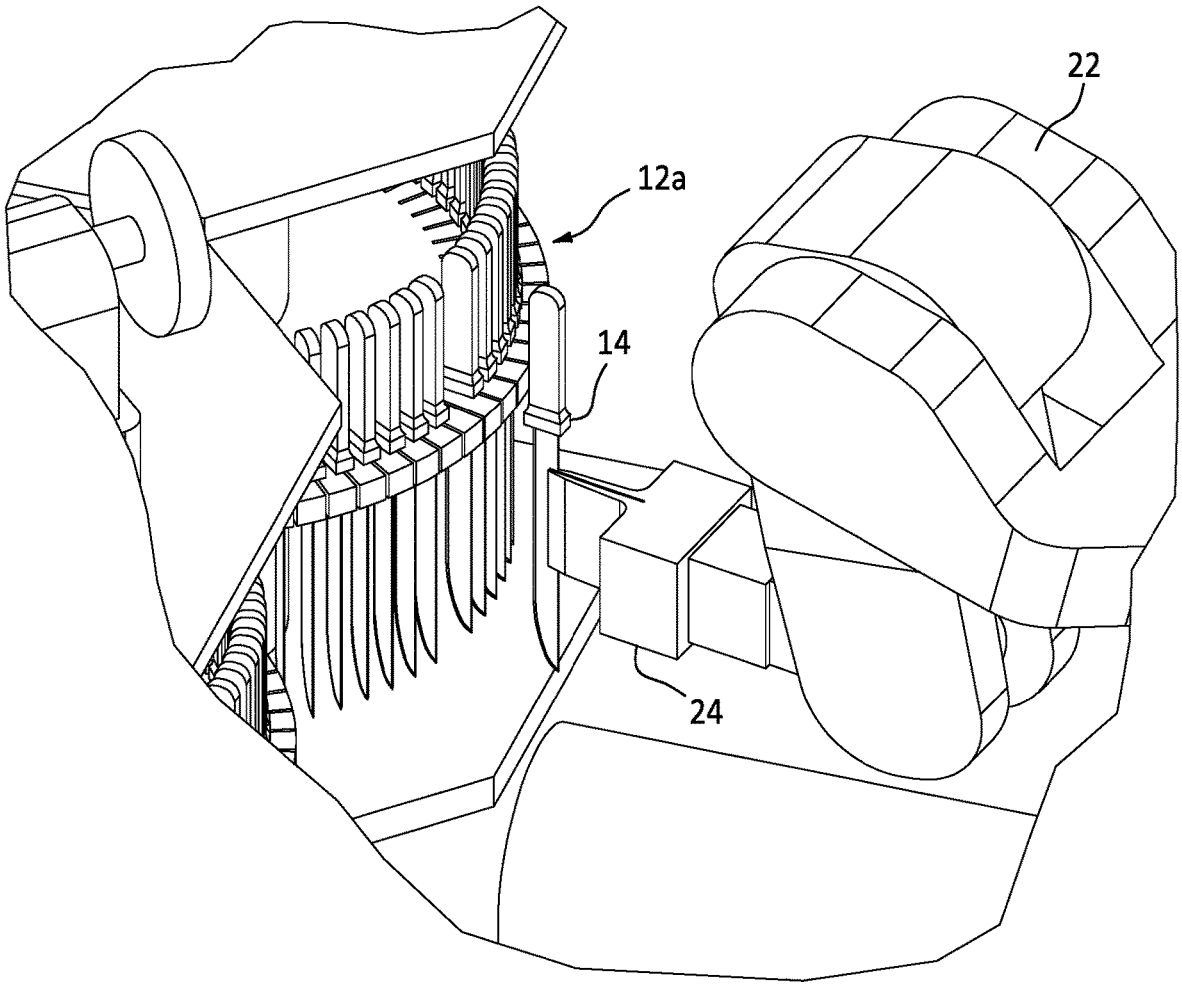
FIG. 2A is a perspective view of an end of arm gripper of a robotic arm selecting a cutting tool from a rotary magazine by gripping the blade a distance away from the cutting edge of the blade, in accordance with one exemplary embodiment of the present invention.

Referring to FIG. 1, a system 10 for automated sharpening or resharpening of cutting tools, in accordance with one embodiment of the present invention, is shown. System 10 advantageously includes two rotary magazines 12*a*, 12*b*, which hold a plurality of cutting tools 14, a vision station 16, a grinding station 18, a polishing station 20 and a robotic arm 22 with an end of arm gripper 24. As shown in FIG. 2A, the robotic arm 22 with end of arm gripper 24 is configured to locate and grip the blade of a cutting tool 14 a distance away from its cutting edge.

Components and other features of the inventive system will now be described in detail below.

Magazine(s)

The magazine or magazines used in the present inventive system serve to hold and advance cutting tools. This eliminates the need for specially designed racks or bins.

In an exemplary embodiment, as shown in FIG. 1, the magazine(s) is a rotary magazine(s) and a plurality of support members (e.g., slotted support members configured to removably secure a plurality of cutting tools) are arranged radially in the magazine, such that the cutting devices hang in a vertical fashion, with the cutting edge of each blade facing inward. The handle of each cutting tool is positioned above its respective slotted support member, while the blade of each cutting tool is positioned within and below the slotted support member.

Each magazine may be made up of one or more radial rows of slotted support members. Thus, the quantity of cutting tools may be doubled (or more) by adding one or more additional radial rows of support members above or below the existing row of support members.

One or more magnets (not shown) may be vertically arranged below each slotted support member, which assist in maintaining a proper vertical orientation of each cutting tool. A proper vertical orientation assures that the tool is correctly griped by the robotic arm to assure that it completely fits within the scanning window(s) of the visual station.

The magnets may adopt any shape (e.g., circular, square, rectangular, triangular) and may be substantially planar or curved to confirm to the arcuate shape of the plurality of support members and magazine.

In one exemplary embodiment, there is one (1) elongate or substantially rectangular magnet that measures from about 6 to about 50 mm in length, that is vertically arranged below each slotted support member.

In another exemplary embodiment, three or more substantially circular magnets, preferably, three magnets, that each measure from about 3 to about 9 mm in diameter, are vertically arranged below each slotted support member.

Neodymium (N42 grade) magnets may be used with this invention. These are sometimes referred to as "super magnets". Sintered neodymium-iron-boron (Nd—Fe—B) magnets are a member of the rare earth magnet family and are one of the most powerful permanent magnets known. An advantage of this type of magnet is that they are very resistant to demagnetization and can be expected to hold their magnetism for the lifetime of the inventive system. It should be appreciated by those skilled in the art that other types of magnets that have equivalent magnetic strength properties to neodymium magnets could be conceivably used with this invention.

More than one magazine may be used within the inventive system. In a preferred embodiment, as shown in FIG. 1, two magazines 12*a*, 12*b*, are used, which allows for an operator to safely load/unload one magazine while the robot is sharpening from the other.

The rotary magazine accommodates from about 25 to about 100 cutting devices. The magazine is programed to index for the next cutting tool to get sharpened until all of the cutting tools are sharpened. The magazine may be advanced by any suitable means including, for example, by a motor or pneumatic cylinder attached to gears or to a ratchet type mechanism. The magazine may also be advanced using a mechanism employing two pins (one stationary and one that moves a specific distance), with the mechanism shuttling the pins in such a way to index the magazine.

For those embodiments employing more than one rotary magazine, once all of the cutting tools in a first magazine are sharpened, the robotic arm will start to pull from another magazine. At that time, the first magazine will become accessible to an operator for removal of the sharpened cutting tools.

The inventive system allows an operator to select if a magazine is loaded with similar shaped cutting tools to potentially reduce overall cycle time.

For those embodiments of the inventive system in which the system is enclosed within a system enclosure, which is described in more detail below, the magazine(s) may be fixed within the enclosure or may be capable of moving laterally to the outside of the enclosure. Removal of sharpened cutting took may therefore occur either from within the enclosure or from the outside of the enclosure, either manually by an operator, or automatically by machine.

Pick and Place Motion

The trajectory paths of the robotic arm while selecting cutting tools from (and returning cutting tools to) the magazine(s) are pre-programmed robotic motion paths. As will be readily understood by those skilled in the art, all operations of the robotic arm are controlled by a control system that controls its position. While manipulation of the pickup and drop off motion trajectories may be necessary, in a preferred embodiment, the magazine(s) is universal enough to allow most tool shapes and sizes to be picked up and returned without any such manipulation.

A distance sensor may be used in the magazine(s), which monitors the presence of a cutting tool handle. If the distance sensor doesn't recognize the presence of a handle, the system would consider the slot in the magazine to be empty and would index to the next slot until it found another handle.

Vision Station

Since the work of the robotic arm is to manipulate cutting tools, three-dimensional information of the manipulated took is necessary. The vision station serves this purpose by scanning and determining the entire cutting edge of each cutting tool. The vision station does not use previously stored contour data.

The term "vision station", as used herein, refers to a three-dimensional (3D) scanner system, which is made up of one or more cameras or 3D profilometers. The 3D scanner system has an automatic door opening/closing mechanism, which serves to protect the sensitive imaging components from dust generated during the grinding and polishing steps. The 3D profilometer(s) is used in conjunction with movement of a cutting device through its focal area. Multiple line scans are captured and stitched together to form a 3D image of the entire cutting edge of the cutting tool (i.e., machine vision images).

The machine vision images obtained for each cutting tool are translated to robot motion (i.e., sharpening/polishing motion paths arrived at based on the imaging data). More specifically, all necessary measurement data from the tip to the heel (i.e., from the start to the end) of the cutting edge of the blade is extracted from the machine vision images. The handle, or grind dwell is used to determine the end of the cutting edge. The tip is determined by observing when the cutting edge and spine data only are the same (i.e., for a single line scan, there is only one data point). The measurement data is extracted from the machine vision images using suitable technologies. In an exemplary embodiment, the robotic arm is an ABB, Inc. robotic arm and the measurement data or output information is translated into accurate and reproducible motion using, for example, RAPID® high-level programming language (i.e., RAPID instructions), which is transferred to the robotic arm controller for the purpose of guiding the robotic arm through the grinding and polishing steps.

The 3D profilometer(s) is used to determine the size and surface profile of the entire cutting edge of the cutting tool. The terms "scan width" and "scan length" are intervals in distance at which the profilometer makes measurements. The 3D profilometer has a known and fixed scan width ranging from about 20 to about 130 mm. The scan length, which may run from about 100 to about 350 mm, is set by an operator to approximate the length of the largest cutting tool blade loaded on the magazine(s) during each system cycle.

Due to the method of capturing and processing the image for the entire cutting edge of each blade (i.e., the scan and how the sharpening process is executed), the robotic arm is capable of evenly sharpening a cutting edge with a bend or warp.

Figure 2B:
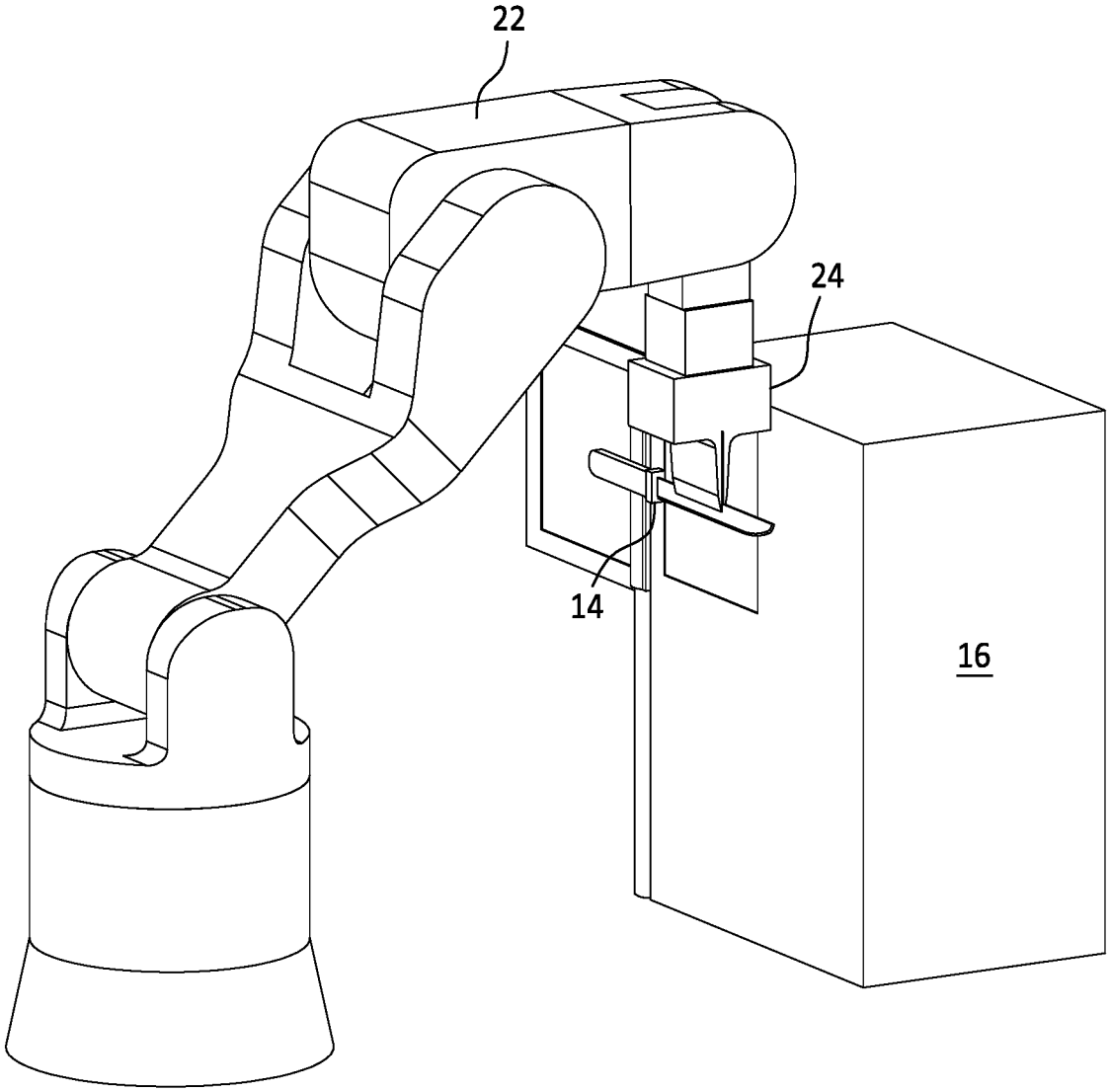
Figure 2C:
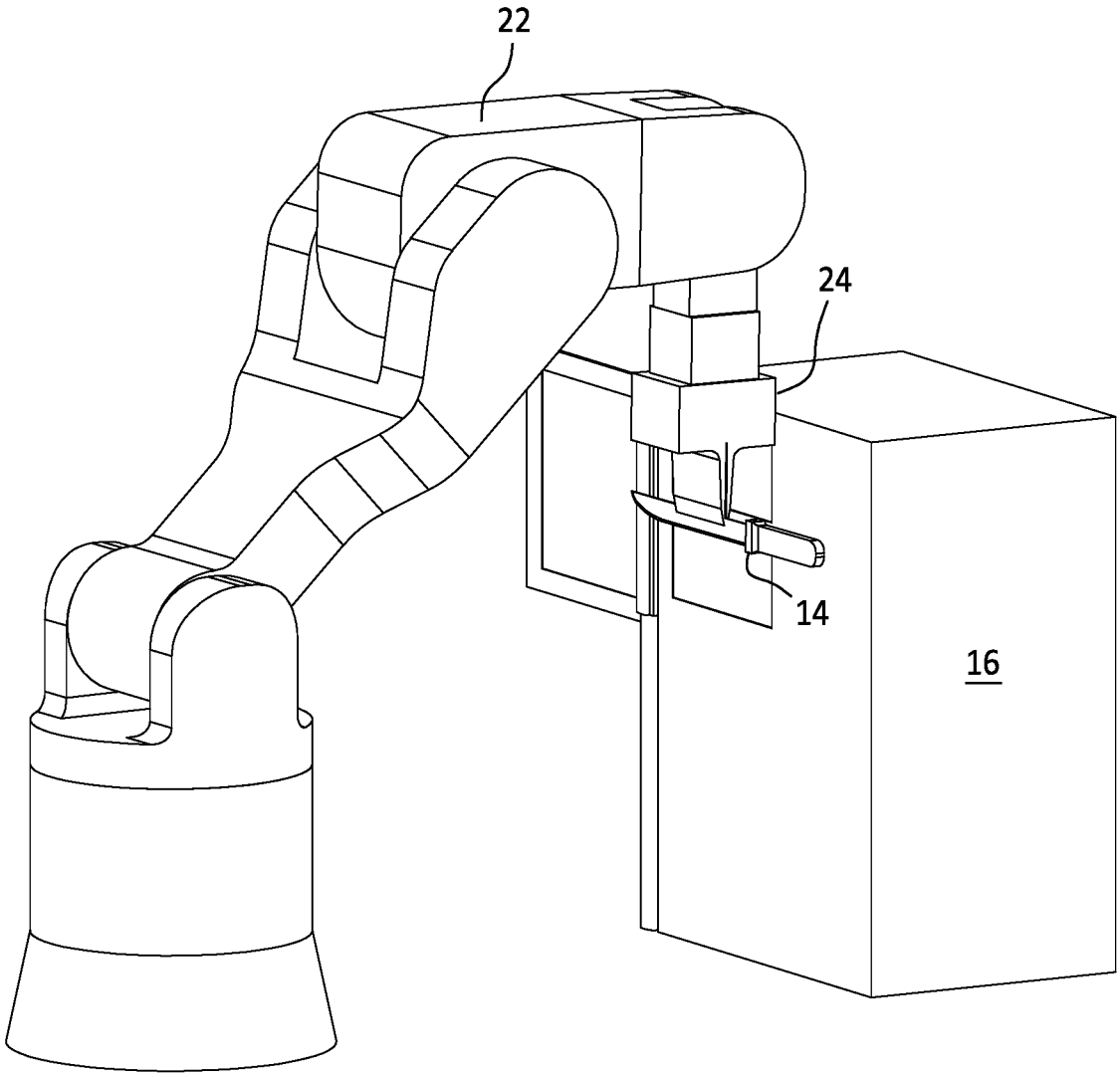
FIG. 2C is a perspective view of the gripper providing the cutting tool for scanning the opposite side of the blade at the vision station.

In one exemplary embodiment, the vision station is made up of one 3D profilometer, and as shown in FIGS. 2B and 2C, each side of the cutting device is moved through its focal area in succession and the resulting line scans captured and stitched together to form a 3D image of the cutting tool.

In another exemplary embodiment, the vision station is made up of two, oppositely opposed, 3D profilometers, and the cutting device is moved between the profilometers through their respective focal areas, with both sides of the cutting device being scanned at the same time. By scanning both sides of the device simultaneously, machine cycle time is reduced.

In yet another exemplary embodiment, the vision station also includes a QR code scanning device. A scannable QR code is added to each cutting device in an area on the main body portion of the blade which is remote from both the area contacted by the gripper of the robotic arm and the cutting edge of the blade. The QR code scanning device may operate concurrently or sequentially with the profilometer(s) scan. After the QR code is scanned, the QR code is identified to obtain data symbol information stored in the QR code. As will be readily appreciated by those skilled in the art, the use of scannable QR codes on cutting tools may be used to track the tools in, for example, processing plants, monitoring persons, shifts and returns of the cutting tools, the number of times each cutting tool has been sharpened and the life of the cutting tool. In this exemplary embodiment, the inventive system will recognize a serial number for a tool and store sharpening data/images for that tool to a designated file. The system may then communicate the collected tool data with a data collection system utilized in the processing facility (e.g., INNOVA ZONES inventory control, inventory management platforms).

Rejects

If the scan data indicates that: (a) the gripper 24 is too close to the cutting edge of the cutting tool 14; (b) the cutting tool does not fit inside the scan window or there is another form of a scan fault; (c) there is a major flaw (i.e., a chip or a gouge) in the surface of the cutting tool; or (d) the cutting edge of the cutting tool is too thin, then the robot will move the tool to a reject location for collection and proceed to load another tool.

The system will also reject a cutting tool if: a system operator stops the system; the air pressure within the system enclosure falls below 415 kilopascals (kPa); or a fault occurs in the form of, for example, a camera communication fault, a grinder or polishing motor fault, or a diameter sensor/DAQ fault or bad diameter reading for a polishing wheel.

Processing Stations

The one or more processing stations of the present inventive system process each side of the entire cutting edge of each cutting tool separately.

Grinding Station

The grinding machine used in the present inventive system achieves a consistent contour and uniform sharpened edge along the blade. The grinding medium used in the grinding machine may be made using any suitable abrasive and in an exemplary embodiment is selected from the group of grinding or sanding belts made of zirconium oxide (zirconia) and ceramic abrasives and grinding stones made of diamond, silicon carbide, aluminum oxide, soft and hard Arkansas, ceramic, and Japanese water stones. For those embodiments in which the grinding medium is a grinding stone wheel, a diameter sensor may be employed, allowing the system to compensate for wheel wear, and to alert the user when the wheel needs to be replaced.

Figure 3A:
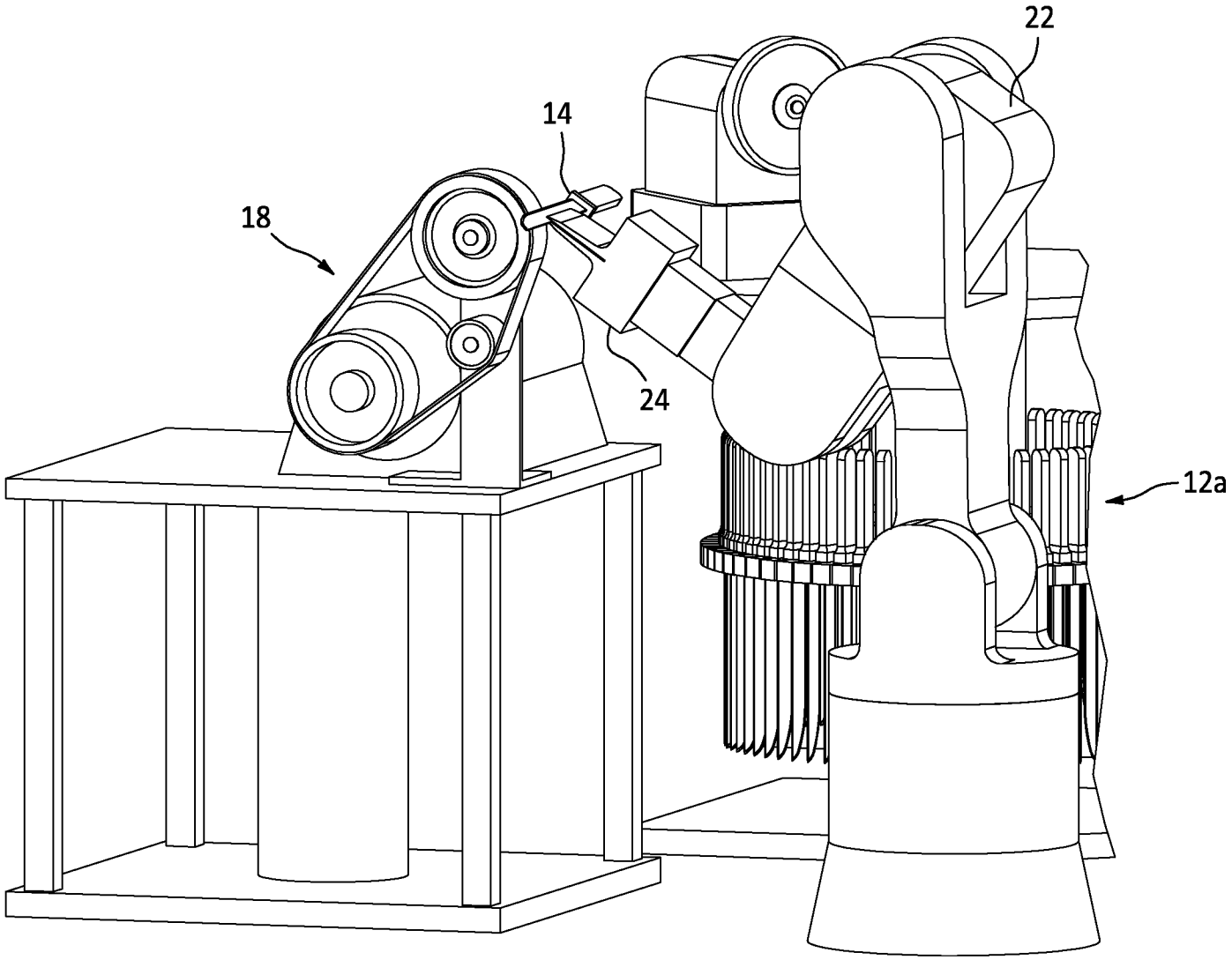
Figure 3B:
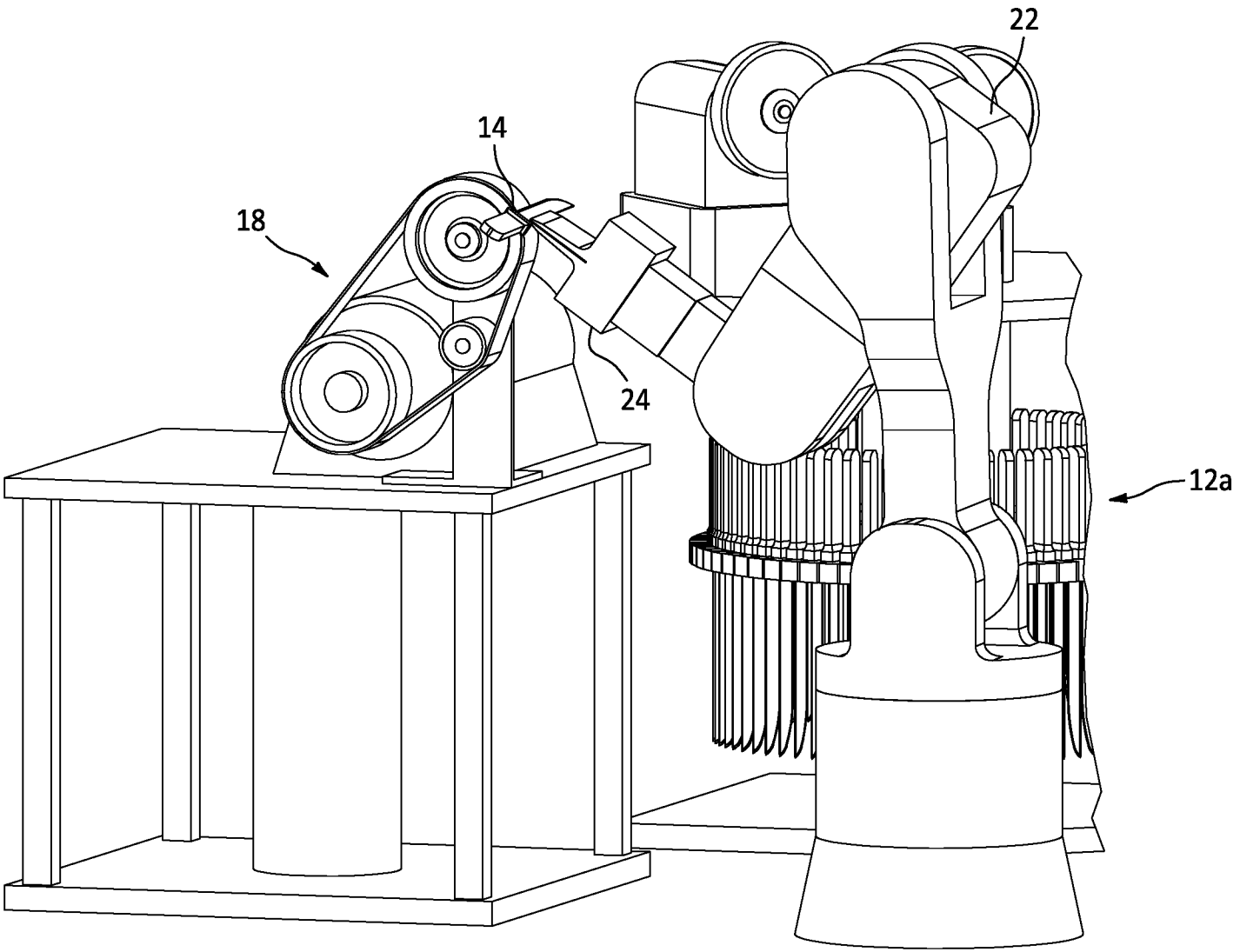
FIG. 3B is a perspective view of the gripper providing the cutting tool for grinding the opposite side of the blade at the grinding station.

In exemplary embodiments, the grinding medium is a zirconia or ceramic sanding belt having various abrasive grain types or shapes. As best shown in FIG. 3A, the grinding machine 18 is a belt grinder, which employs a ceramic sanding belt driven by a motor. In this exemplary embodiment, the belt has a ceramic precision shaped grain for optimum belt life, a width ranging from about 2.54 to about 7.62 centimeters (cm), a length ranging from about 119.38 to about 124.46 cm, and a grit ranging from No. 120 grit to No. 400 grit. As best shown in FIGS. 3A and 3B, the grinding machine 18 sharpens each side of the entire cutting edge of each cutting tool separately and in succession.

Suitable grinding machines in the form of belt grinders and belt sanders are widely available from known manufacturers.

The angle of the grinding medium to the edge of the blade preferably ranges from about 25 to about 45 degrees. As will be readily appreciated, when sharpening longer blades, the cycle time will and should be longer than when sharpening a shorter blade. As noted above, 100% of the cutting edge of the cutting tool is sharpened during this process.

Sharpness levels obtained by the invention system are represented by Anago Scores of greater than or equal to 8.0, preferably, greater than or equal to 8.5.

The inventive system may be configured to indicate when the grinding belt must be replaced. In an exemplary embodiment, the system is configured to calculate the length of cutting edges sharpened, and when that value exceeds a set number, the system will indicate to the user that the grinding belt needs to be replaced.

Polishing Station

Figure 4A:
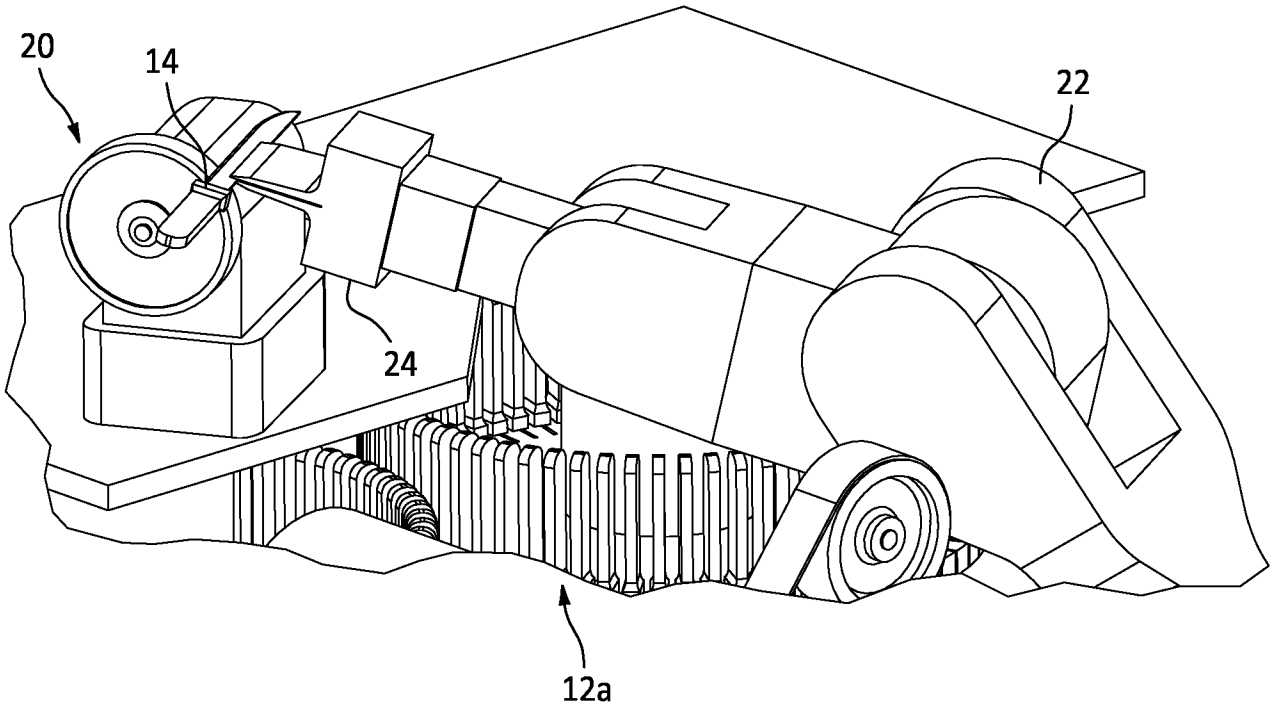

In an exemplary embodiment, as best shown in FIG. 4A, the polishing station 20 is made up of a polishing buffing wheel driven by a motor. The polishing station 20 may also include a diameter sensor (not shown) and a polishing compound applicator (also not shown).

Suitable polishing buffing wheels include, but are not limited to, cotton buff, Fixed Abrasive Buff (FAB), muslin buff and leather buffing wheels. A polishing compound is applied to the wheel before polishing. Suitable polishing compounds include, but are not limited to, white or brown rouge in liquid or cake forms.

Suitable polishing units in the form of buffers and polishers are widely available from known manufacturers.

Figure 4B:
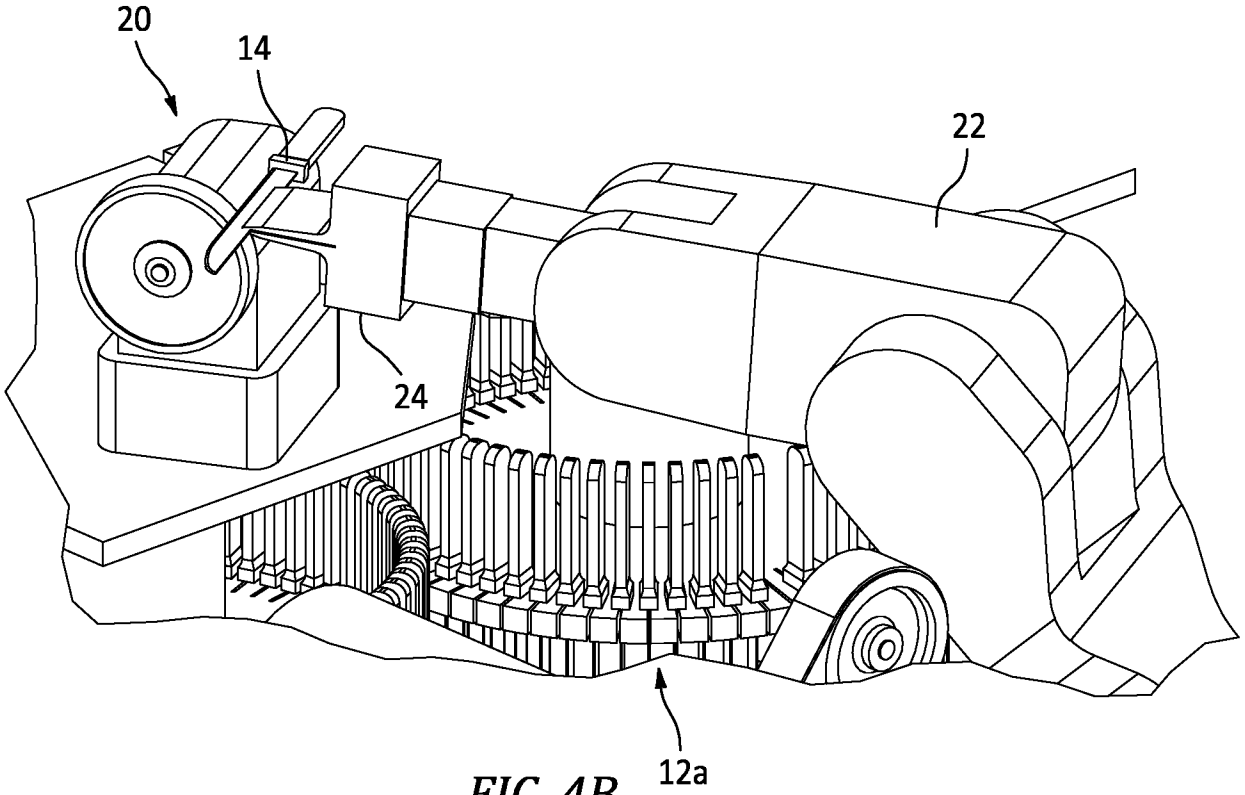
FIG. 4B is a perspective view of the gripper providing the cutting tool for polishing the opposite side of the blade at the polishing station.

The angle of the polishing buffing wheel to the edge of the bade preferably ranges from about 17 to about 30 degrees. As best shown in FIGS. 4A and 4B, the polishing machine 20 sharpens each side of the entire cutting edge of each cutting tool 14 separately and in succession. As will be readily appreciated by those skilled in the art, timing will vary based on the length of the cutting edge.

The inventive system may be configured to indicate when the polishing belt must be replaced. In one such exemplary embodiment, a distance sensor, which measures the diameter of the buffing wheel, is employed. When the wheel diameter falls below a set value, the system will alert the user to replace the wheel.

The effectiveness of the polishing process is indicated by an Anago Score of greater than or equal to 8.0, preferably, greater than or equal to 8.5.

A polishing wheel laser sensor may also be used in conjunction with the polishing unit to measure the polishing wheel diameter and to use this value to fine-tune the robot polishing motion profile. In one such embodiment, diameter sensor data is fed back to the controller to update the robotic arm's move positions for the polishing operations (e.g., in RAPID®, the data is used to update the Tool Center Point by establishing an offset from the original wheel diameter).

Sharpness Testers

One or more sharpness testers may be positioned within the inventive system.

In one exemplary embodiment, a sharpness tester is positioned after the grinding and polishing stations to test whether the blade sharpening process was efficient. If the sharpness tester indicates an Anago Score below an established level, the cutting tool would be reimaged and resharpened while the robotic arm was holding it. If the sharpness tester indicates on two consecutive occasions an Anago Score below the established level, the cutting tool would be sent to a reject location for collection.

In another exemplary embodiment, a sharpness tester is also positioned before the Vision Station to test whether a blade needs to be sharpened before sharpening the blade. If the sharpness tester indicates an Anago Score at or above an established level, the cutting tool would be returned to its slot in the magazine.

Suitable knife sharpness testers (e.g., KST300E with Automation Module) are available from Anago Limited, Hamilton, New Zealand.

Such a sharpness tester provides the system with a blade sharpness profile. This profile gives a visual indication of the blade's sharpness measured at 2 mm intervals along the length of the blade. The results help determine the sharpness of the blade and any dull/sharp areas as well as nicks in the blade.

Acceptable Anago Scores for blade sharpness range from 8.0 to 9.0, preferably, from 8.5 to 8.7.

Robotic Arm

Suitable robotic arms programmed with unlimited sequence control (e.g., IRB compact robot) may be obtained from ABB Inc., 1250 Brown Rd., Auburn Hills, MI 48326.

As will be readily understood by those skilled in the art, all operations of a robotic arm are controlled by a control system that controls the mechanism position. Since the work of the robotic arm is to manipulate cutting tools, three-dimensional information of the environment or manipulated cutting tools is necessary.

The trajectory paths to a magazine to extract a cutting tool, from the magazine to the vision station, while at the vision station, from the vision station to the grinding and polishing stations, to a reject collection location, and from the polishing station back to the magazine are pre-programmed sequences.

The trajectory paths while at the grinding and polishing stations, however, are defined by the output information from the vision station using an algorithm to locate the beginning and the end of the cutting edge of the cutting tool from the three-dimensional image, extrapolating X, Y and Z cutting edge data, conveying the extrapolated data to a robotic arm controller, which converts the extrapolated data to motion instructions and conveys the motion instructions to the robotic arm.

The end of arm gripper 24 of the robotic arm 22 is selected from the group of parallel grippers, pneumatic parallel grippers and electric parallel grippers, and may be configured in different sizes to handle a range of cutting tool sizes.

In an exemplary embodiment, as best shown in FIG. 1, the end of arm gripper 24 is a pneumatic parallel gripper with a pair of fingers. Suitable pneumatic parallel grippers are available from known manufacturers. In another exemplary embodiment, the gripper is a slip resistant gripper, which is coated with a material such as rubber or urethane to increase friction to resist axial or rotational movement while the cutting tool is gripped. In a preferred embodiment, a tear resistant urethane material is coated onto contact surfaces of the gripper fingers.

In yet another exemplary embodiment, at least a portion of a contact surface of a gripper finger is textured in, for example, a hatch pattern, to further increase the slip resistance of the gripper.

Figure 5A:
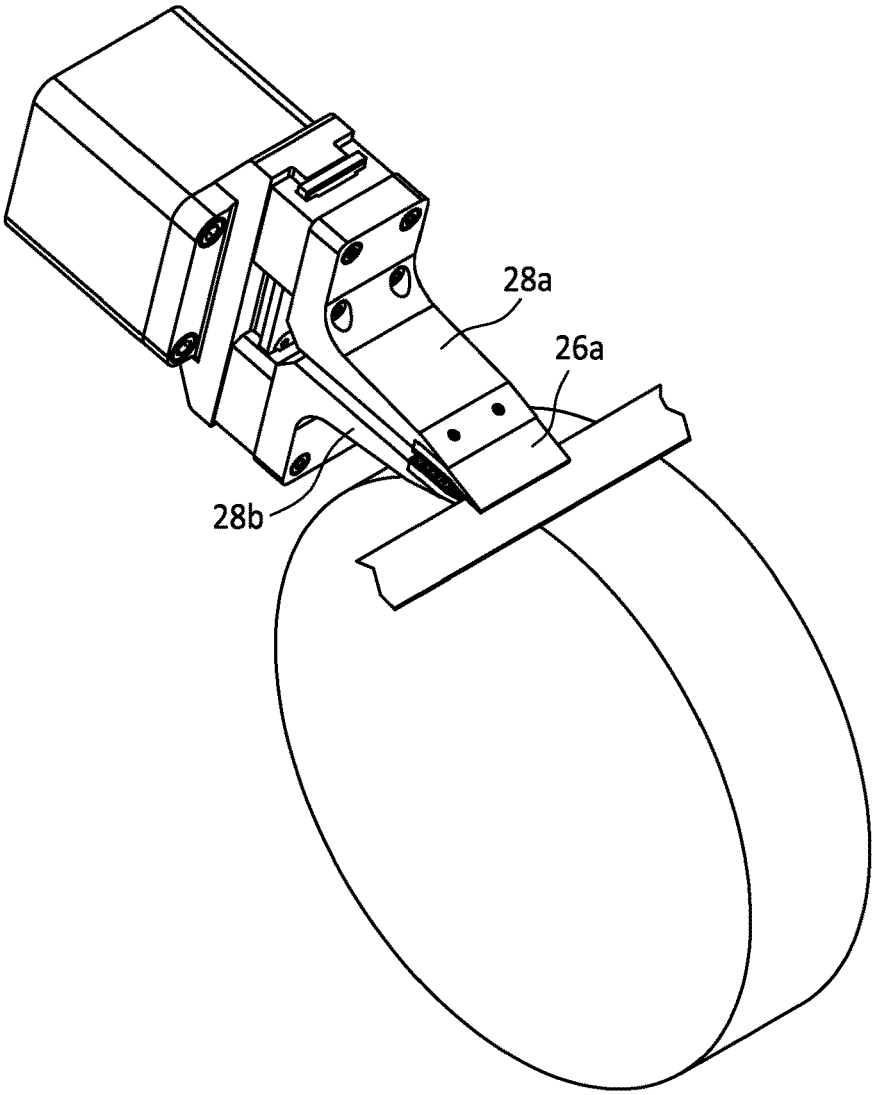
Figure 5B:
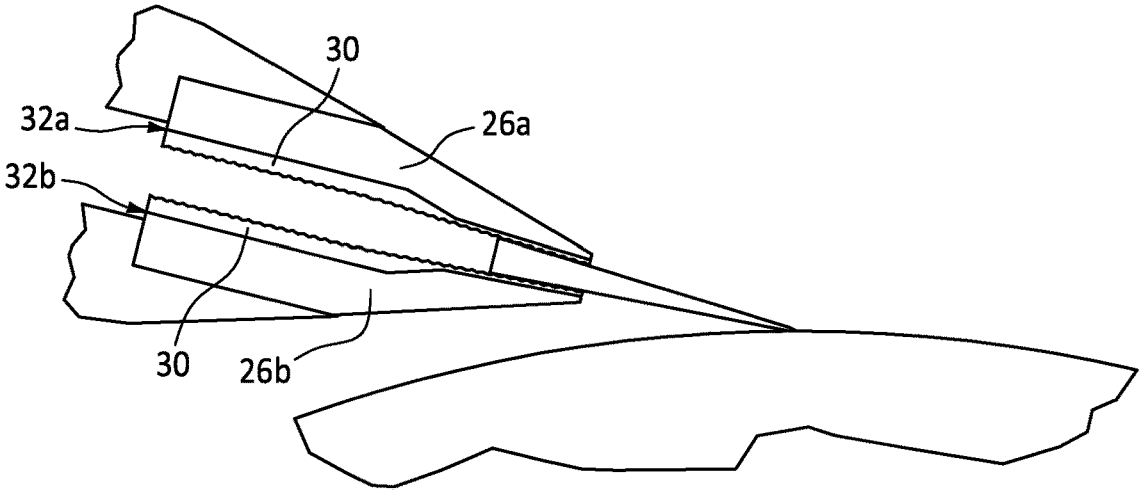
FIG. 5B is an enlarged side perspective view of the gripper inserts of FIG. 5A, showing a slip-resistant material applied to inner contact surfaces of the gripper inserts.

In yet a further exemplary embodiment, as shown in FIGS. 5A and 5B, two gripper inserts 26*a*, 26*b*, are each mounted (e.g., using 2 flat head screws per insert) on one oppositely disposed gripper finger 28*a*, 28*b*. The position of these gripper inserts is therefore fixed (i.e., not being able to be adjusted). Each gripper insert 26*a*, 26*b*, which represents an extension of its respective gripper finger, is tapered at an angle from the gripper finger 28*a*, 28*b*. The two gripper inserts are made from a material different than that used to make the gripper 24 (e.g., a hardened A2 tool steel (58-60 RHC)) and thus can overcome the stresses during the clamping, grinding and polishing operations. An optionally textured, slip-resistant material 30 (e.g., a tear resistant urethane material) may be applied to the inner contact surfaces 32*a*, 32*b*, of the gripper inserts 26*a*, 26*b*.

In another exemplary embodiment, the pair of gripper fingers 28*a*, 28*b*, are not used with one or more gripper inserts, but instead the end of the gripper fingers adopt the geometry of the gripper inserts shown, for example, in FIGS. 5A and 5B.

As noted above, the robotic arm is configured to locate and grip a cutting tool at a specific distance away from the inner cutting edge of the blade, to remove the cutting tool from its location in a magazine and then to convey the cutting tool to the vision station, to the one or more processing stations and then back to the same location in the magazine, and then to repeat the above sequence until all of the cutting tools in the magazine(s) are sharpened or resharpened.

The robotic arm grasps the blade of each cutting tool at a set distance away from the cutting edge. In an exemplary embodiment, the end of arm gripper grasps the cutting blade at a distance of at least about 4.5 mm away from the cutting edge, preferably from about 4.5 to about 10 mm. If the end of arm gripper grasps the blade at a distance of less than 4.5 mm away from the cutting edge, then the gripper may be damaged during the grinding and polishing operations. If grasped at a distance of more than 10 mm away, then the robotic arm would not be able to consistently pick-up the cutting tool or may drop the tool during the sharpening or polishing process.

System Enclosure

The inventive system is preferably housed within an enclosure. The enclosure provides important benefits, namely, it protects operators from the robotic arm, and it helps to protect the robotic arm from being damaged by other equipment. The enclosure also serves to contain sharpening debris (e.g., metal shavings/polishing compound). The enclosure can be made from any suitable material including expanded metals, sheet metals (e.g., aluminum sheet metal) and plastic sheet materials (e.g., polycarbonate) and may be customized by adding options such as safety lights to signal when access doors are open, emergency stop buttons, door interlocks for safety, etc.

One or more outer (or front) guard doors provide an operator with access to the magazine(s) for loading and unloading of cutting tools. One or more inner guard doors provide the robotic arm with access to the magazine(s) for sharpening and polishing.

User Interface

The inventive system is controlled by a controller having a user interface (e.g., a touch screen user interface, a keyboard/mouse user interface). The user interface allows an operator to manually lock/unlock the system enclosure, open/close the magazine access doors in the enclosure, manually move the robotic arm, toggle actuators in the system, and adjust a number of thresholds and settings including, but not limited to, sharpening angle(s), belt replacement, buffer wheel replacement, buffer calibration, stock-keeping units (SKUs) in magazine, grinding/polishing speeds and review of alarm/error codes.

Sequence of Operation

Figure 6:
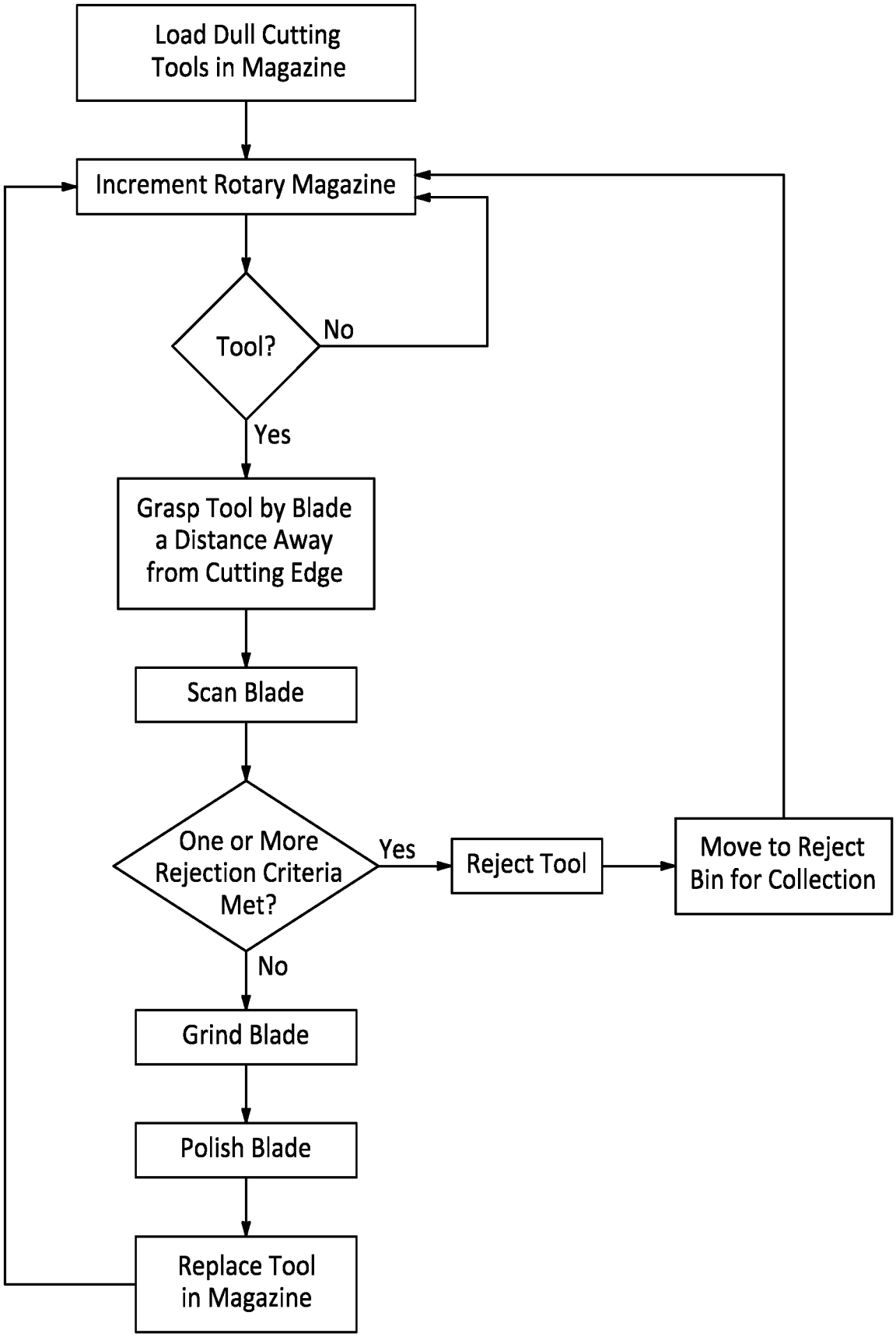
FIG. 6 is a method flowchart for one exemplary embodiment of the method of the present invention.

The sequence of operation of the exemplary system embodiment shown in the drawings when housed in an enclosure, which is depicted in part in the method flowchart shown in FIG. 6, is as follows.

1. an operator opens front guard doors to load two magazines of dull knives and then closes the guard doors;
2. the operator starts the machine;
3. the gripper grabs the blade of the knife a distance away from the cutting edge;
4. the robotic arm presents the blade to the vision station where the blade is imaged;
5. blade edge data is extracted from the blade images, converted to robotic arm targets or points in space that can be followed by the robotic arm and then a file with these targets or points in space opened with the robotic arm controller and converted to move instructions using the controller;
6. the robotic arm uses the instructions to maneuver the blade across a grinding belt at the grinding station in two passes to sharpen both sides of the blade;
7. the robotic arm then maneuvers the blade past the polishing wheel in two passes to polish both sides of the blade;
8. optionally, the robotic arm moves the blade into an Anago unit for sharpness reading;
9. the robotic arm then places the blade back into the same location in the same magazine;
10. repeat.

During auto cycle, an operator can open the front guard doors to unload the finished magazine and load it with dull knives. Then, close the front guard doors. When the left-side magazine has been fully processed, the left-side tray cover closes, the right-side tray cover opens, and the robotic arm continues with the right-side magazine. This may of course also progress in the opposite direction, namely, when the system is finished with the right-side magazine and moves to process the left-side magazine, the right-side magazine can be unloaded/loaded while the left-side magazine is being processed.

The inventive system and method permits a precise, reproducible grind or regrind of cutting took having widely varying sizes and degrees of wear, with high efficiency and grinding/polishing quality.

Although exemplary embodiments have been shown and described, it will be clear to those of ordinary skill in the art that a number of changes, modifications, or alterations to the invention as described can be made. All such changes, modifications, and alternations should therefore be seen as within the scope of the disclosure.

We claim:

1. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations, wherein one processing station is a grinding element;

(d) a robotic arm with a gripper, which is configured to move to and grip the blade of each cutting tool a distance away from the inner cutting edge of the blade, to remove the cutting tool from where the cutting tool is located in the one or more magazines, and then to convey the cutting tool though the system; and (e) a control subsystem for controlling the one or more magazines, the vision station, the one or more processing stations, and the robotic arm, wherein, the control subsystem is programmed to position the robotic arm relative to the grinding element when the robotic arm is gripping the blade of a cutting tool, and to allow for one side of the cutting edge of the blade to be processed by the grinding element, and then the other side of the cutting edge of the blade to be processed by the grinding element.

2. The system of claim 1, wherein the robotic arm with a gripper is configured to grip the blade of each cutting tool at a distance of at least about 4.5 millimeters away from the inner cutting edge of the blade.

3. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations;

(d) a robotic arm with a gripper, which is configured to move to and grip the blade of each cutting tool a distance away from the inner cutting edge of the blade, to remove the cutting tool from where the cutting tool is located in the one or more magazines, and then to convey the cutting tool though the system; and (e) a control subsystem for controlling the one or more magazines, the vision station, the one or more processing stations, and the robotic arm, wherein the one or more magazines are one or more rotary magazines, which are rotatably mounted and configured to rotate about an axis, and which hang each cutting tool in a vertical fashion or orientation.

4. The system of claim 3, wherein each rotary magazine is made up of a plurality of slotted support members configured to removably secure the plurality of cutting tools, which are arranged radially in the one or more rotary magazines, wherein the handle of each cutting tool is positioned above the cutting tool's respective slotted support member, while the blade of each cutting tool is positioned within and below the slotted support member.

5. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations selected from the group including a grinding station and a polishing station;

(d) a robotic arm with a gripper, which is configured to move to and grip the blade of each cutting tool a distance away from the inner cutting edge of the blade, to remove the cutting tool from where the cutting tool is located in the one or more magazines and then to convey the cutting tool to the vision station, to the one or more processing stations and then back to the same location in the one or more magazines, and then to repeat the above sequence until all of the cutting tools in the one or more magazines are sharpened or resharpened; and (e) a control subsystem for controlling the one or more magazines, the vision station, the one or more processing stations, and the robotic arm, wherein, the control subsystem is programmed to position the robotic arm relative to the grinding station when the robotic arm is gripping the blade of a cutting tool, and to allow for one side of the cutting edge of the blade to be processed by the grinding station, and then the other side of the cutting edge of the blade to be processed by the grinding station.

6. The system of claim 5, which further comprises one or more sharpness testers.

7. The system of claim 5, wherein the vision station comprises one or more three-dimensional profilometers.

8. The system of claim 7, wherein the vision station comprises only one three-dimensional profilometer.

9. The system of claim 7, wherein the vision station comprises two three-dimensional profilometers, disposed opposite each other.

10. The system of claim 7, wherein the plurality of cutting tools each display a QR code, and wherein the vision station further comprises a QR code scanning device.

11. The system of claim 5, wherein the one or more processing stations process each side of the entire cutting edge of each cutting tool in succession.

12. The system of claim 5, wherein the robotic arm with a gripper is configured to grip the blade of each cutting tool at a distance of at least about 4.5 millimeters away from the inner cutting edge of the blade.

13. The system of claim 12, wherein the robotic arm with a gripper is configured to grip the blade of each cutting tool at a distance ranging from about 4.5 to about 10 millimeters away from the inner cutting edge of the blade.

14. The system of claim 5, wherein each gripper finger has a contact surface for gripping a cutting tool, and wherein a gripper insert is mounted on each contact surface of the oppositely disposed gripper fingers.

15. The system of claim 14, wherein the gripper inserts are coated with a material to increase friction to resist axial or rotational movement while the cutting tool is being gripped by the gripper of the robotic arm.

16. The system of claim 15, wherein the material is a urethane compound.

17. The system of claim 15, wherein the coated material is a textured coated material.

18. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations selected from the group including a grinding station and a polishing station;

(d) a robotic arm with a gripper, which is configured to move to and grip the blade of each cutting tool a distance away from the inner cutting edge of the blade, to remove the cutting tool from where the cutting tool is located in the one or more magazines and then to convey the cutting tool to the vision station, to the one or more processing stations and then back to the same location in the one or more magazines, and then to repeat the above sequence until all of the cutting tools in the one or more magazines are sharpened or resharpened; and (e) a control subsystem for controlling the one or more magazines, the vision station, the one or more processing stations, and the robotic arm, which is enclosed within an enclosure having one or more outer or front guard doors that provide an operator with access to the one or more magazines for loading and unloading of cutting tools, and one or more inner guard doors that provide the robotic arm with access to the cutting tools in the one or more magazines for sharpening and polishing.

19. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations selected from the group including a grinding station and a polishing station;

(d) a robotic arm with a gripper, which is configured to move to and grip the blade of each cutting tool a distance away from the inner cutting edge of the blade, to remove the cutting tool from where the cutting tool is located in the one or more magazines and then to convey the cutting tool to the vision station, to the one or more processing stations and then back to the same location in the one or more magazines, and then to repeat the above sequence until all of the cutting tools in the one or more magazines are sharpened or resharpened; and (e) a control subsystem for controlling the one or more magazines, the vision station, the one or more processing stations, and the robotic arm, wherein the one or more magazines are one or more rotary magazines, which are rotatably mounted and configured to rotate about an axis, and which hang each cutting tool in a vertical fashion or orientation.

20. The system of claim 19, wherein each rotary magazine is made up of a plurality of slotted support members configured to removably secure the plurality of cutting tools, which are arranged radially in the one or more rotary magazines, wherein the handle of each cutting tool is positioned above the cutting tool's respective slotted support member, while the blade of each cutting tool is positioned within and below the slotted support member.

21. The system of claim 20, wherein one or more magnets are vertically arranged below each slotted support member, which assist in maintaining a proper vertical orientation of each cutting tool.

22. The system of claim 21, wherein three substantially circular magnets are vertically arranged below each slotted support member.

23. The system of claim 19, which comprises two rotary magazines.

24. A system for automated sharpening or resharpening of cutting tools, which comprises:

(a) one or more rotary magazines for holding a plurality of cutting tools, which are rotatably mounted and configured to rotate about an axis, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations selected from the group including a grinding station and a polishing station;

(d) a robotic arm with a gripper, which is configured to move to and grip the blade of each cutting tool a distance away from the inner cutting edge of the blade, to remove the cutting tool from where the cutting tool is located in the one or more magazines and then to convey the cutting tool to the vision station, to the one or more processing stations and then back to the same location in the one or more magazines, and then to repeat the above sequence until all of the cutting tools in the one or more magazines are sharpened or resharpened; and (e) a control subsystem for controlling the one or more magazines, the vision station, the one or more processing stations, and the robotic arm.

25. The system of claim 24, wherein the one or more rotary magazines hang each cutting tool in a vertical fashion or orientation.

26. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations selected from the group including a grinding station and a polishing station;

(d) a robotic arm with a gripper, which is configured to move to and grip the blade of each cutting tool at a distance of at least about 4.5 millimeters away from the cutting edge of the blade, to remove the cutting tool from where the cutting tool is located in the one or more magazines and then to convey the cutting tool to the vision station, to the one or more processing stations and then back to the same location in the one or more magazines, and then to repeat the above sequence until all of the cutting tools in the one or more magazines are sharpened or resharpened; and (e) a control subsystem for controlling the one or more magazines, the vision station, the one or more processing stations, and the robotic arm, wherein, the control subsystem is programmed to position the robotic arm relative to the grinding station when the robotic arm is gripping the blade of a cutting tool, and to allow for one side of the cutting edge of the blade to be processed by the grinding station, and then the other side of the cutting edge of the blade to be processed by the grinding station.

27. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations selected from the group including a grinding station and a polishing station;

(d) a robotic arm with a gripper, which is configured to move to and grip the blade of each cutting tool a distance away from the inner cutting edge of the blade, to remove the cutting tool from where the cutting tool is located in the one or more magazines and then to convey the cutting tool to the vision station, to the one or more processing stations and then back to the same location in the one or more magazines, and then to repeat the above sequence until all of the cutting tools in the one or more magazines are sharpened or resharpened; and (e) a control subsystem for controlling the one or more magazines, the vision station, the one or more processing stations, and the robotic arm, wherein, the control subsystem is programmed to position the robotic arm relative to the grinding station when the robotic arm is gripping the blade of a cutting tool, and to allow for one side of the cutting edge of the blade to be processed by the grinding station, and then the other side of the cutting edge of the blade to be processed by the grinding station wherein each gripper finger has a contact surface for gripping a cutting tool, and wherein a gripper insert is mounted on each contact surface of the oppositely disposed gripper fingers.

28. The system of claim 27, wherein the gripper inserts are coated with a material to increase friction to resist axial or rotational movement while the cutting tool is being gripped by the gripper of the robotic arm.

29. A method for automated sharpening or resharpening of cutting tools using the system of claim 1, wherein the method comprises arranging for the robotic arm to:

(a) locate a cutting tool positioned in the one or more magazines;

(b) grip the blade of a cutting tool a distance away from the inner cutting edge of the blade;

(c) remove the cutting tool from where the cutting tool is located in the one or more magazines;

(d) convey the cutting tool to the vision station where both sides of the blade are scanned to produce a three-dimensional image of the blade;

(e) convey the cutting tool to the one or more processing stations to sharpen or resharpen the cutting tool;

(f) convey the sharpened or resharpened cutting tool to the same location in the one or more magazines; and (g) repeat steps (a) to (f) until all of the cutting devices in the one or more magazines have been sharpened or resharpened.

30. The method of claim 29, wherein step (b) further comprises arranging for the robotic arm to grip the blade of each cutting tool at a distance of at least about 4.5 millimeters away from the inner cutting edge of the blade.

31. The method of claim 30, wherein the robotic arm grips the blade of each cutting tool at a distance ranging from about 4.5 to about 10 millimeters away from the inner cutting edge of the blade.

32. The method of claim 29, wherein step (e) comprises arranging for the robotic arm to convey the cutting tool to the one or more processing stations to separately sharpen or resharpen each side of the blade of the cutting tool in succession.

33. A method for automated sharpening or resharpening of cutting tools using a system made up of one or more magazines for holding a plurality of cutting tools, wherein each cutting tool is made up of a handle and a blade, the blade having two lateral edges, an outer edge or spine and an inner edge for cutting, a vision station, one or more processing stations, and a robotic arm with a gripper, wherein the method comprises arranging for the robotic arm to:

(a) locate a cutting tool positioned in the one or more magazines;

(b) grip the blade of a cutting tool a distance away from the inner cutting edge of the blade;

(c) remove the cutting tool from where the cutting tool is located in the one or more magazines;

(d) convey the cutting tool to the vision station where both sides of the blade are scanned to produce a three-dimensional image of the blade;

(e) convey the cutting tool to the one or more processing stations to sharpen or resharpen the cutting tool;

(f) convey the sharpened or resharpened cutting tool to the same location in the one or more magazines; and (g) repeat steps (a) to (f) until all of the cutting devices in the one or more magazines have been sharpened or resharpened, wherein step (a) further comprises arranging for the robotic arm to locate a cutting tool positioned in one or more rotary magazines, which are rotatably mounted and configured to rotate about an axis, and which hang a plurality of cutting tools in a vertical fashion or orientation.

34. The method of claim 33, wherein step (a) further comprises arranging for the robotic arm to locate a cutting tool positioned in one of two rotary magazines.

35. A system for automated sharpening or resharpening of cutting tools, which comprises:

(a) one or more magazines for holding a plurality of cutting tools, wherein each cutting tool is made up of a handle and a blade, the blade having two lateral edges, an outer edge or spine and an inner edge for cutting;

(b) a vision station operable to produce a three-dimensional image of the blade of each cutting tool;

(c) one or more processing stations;

(d) only one robotic arm with only one end of arm gripper having only one pair of oppositely disposed gripper fingers, which is configured to move to and grip the blade of each cutting tool a distance away from the inner cutting edge of the blade, to remove the cutting tool from where the cutting tool is located in the one or more magazines, and then to convey the cutting tool though the system; and (e) a control subsystem for controlling the one or more magazines, the vision station, the one or more processing stations, and the robotic arm.

* * * * *